US006162978A

United States Patent [19]

Chang

[11] Patent Number: 6,162,978

[45] Date of Patent: Dec. 19, 2000

[54] ADJUSTING STRUCTURE FOR MUSICAL INSTRUMENT SUPPORTERS

[76] Inventor: Ming-Yi Chang, P.O. Box 82-144, Taipei, Taiwan

[21] Appl. No.: 09/408,936

[22] Filed: Sep. 30, 1999

[51] Int. Cl.[7] ..... G10D 13/02

[52] U.S. Cl. ..... 84/421; 84/422.3; 84/453

[58] Field of Search ..... 84/421, 422.2, 84/422.3, 453, 327; 248/187.1, 291.1

[56] References Cited

U.S. PATENT DOCUMENTS

| | | | |
|---|---|---|---|
| 5,739,447 | 4/1998 | Hoshino | 84/402 |
| 5,804,747 | 9/1998 | Chen | 84/327 |
| 5,936,176 | 8/1999 | Lombardi | 84/421 |
| 5,973,249 | 10/1999 | Liao | 84/421 |
| 6,096,956 | 8/2000 | Hoshino | 84/421 |

*Primary Examiner*—Robert E. Nappi
*Assistant Examiner*—Shih-yung Hsieh
*Attorney, Agent, or Firm*—A & J

[57] ABSTRACT

An adjusting structure for musical instrument supporters includes a supporting leg, an adjuster integrally formed with an tipper end of the supporting leg and having two circular seats which is spaced apart by a slot, each of the circular seats having a center hole and formed with a shoulder, a positioner being generally cylindrical in shape and formed with a radial threaded hole and an eccentric threaded hole which are located close to an end of the positioner, the positioner being rotatably fitted in the adjuster with the radial threaded hole and the eccentric threaded hole located in the slot, another end of the positioner having a top formed with a first lug and a bottom with a second lug, a packing plate arranged on the shoulders of the circular seats and engaged with the positioner by a fixing bolt which extends through the packing plate the positioner, and a musical instrument supporter having an upper end configured to engage with a musical instrument and a lower end having threads engageable with a threaded hole of the positioner.

3 Claims, 5 Drawing Sheets

ADJUSTING STRUCTURE FOR MUSICAL INSTRUMENT SUPPORTERS

BACKGROUND OF THE INVENTION

1. Field of the Invention

This invention is related to an improvement in an adjusting structure for musical instrument supporters and in particular to one which enables a musical instrument supporter to be folded in parallel with a supporting leg thereby minimizing the space required for storing the musical instrument supporter.

2. Description of the Prior Art

The conventional adjusting seat for musical instrument supporters includes a lower seat provided with a rotating collar on which there is an upper seat. The upper seat has a bent axle with a threaded end engaged with an actuating block for meshing with the rotating collar thereby engaging the teeth at the bottom of the actuating block with the teeth at the groove of the upper seat and therefore fixing the musical instrument on the upper seat.

However, such a conventional adjusting seat suffers from the following drawbacks:

First of all, it is necessary to rotate the axle of the upper seat before the adjustment of the angle and position of the upper seat, so that the adjustment must be carried out before the installation of the musical instrument. As such, the musical instrument must be disengaged from the seat for adjustment when the angle and position of the musical instrument are not correctly adjusted thereby causing much inconvenience in use.

Secondly, since the axle of the upper seat is radially mounted on the rotating collar and the axle is bent for a certain angle, the whole leg frame will protrude out of the lower seat when folded, no matter how the upper seat is moved, thus requiring a relatively large space for storage and therefore causing much inconvenience in stowage.

Furthermore, as the adjusting angle of the upper seat is limited by the engagement between the toothed surface at the bottom of the actuating block and the teeth at the groove of the upper seat, so that the seat can be adjusted in different steps but cannot be adjusted steplessly thereby making the user unable to adjust the musical instrument to the desired position.

Therefore, it is an object of the present invention to provide an improvement in the adjusting structure for musical instrument supporters which can obviate and mitigate the above-noted drawbacks.

SUMMARY OF THE INVENTION

This invention is related to an improvement in an adjusting structure for musical instrument supporters and in particular to one which enables a musical instrument supporter to be folded with a leg frame.

According to a preferred embodiment of the present invention, An adjusting structure for musical instrument supporters includes a supporting leg, an adjuster integrally formed with an upper end of the supporting leg and having two circular seats which is spaced apart by a slot, each of the circular seats having a center hole and formed with a shoulder, a positioner being generally cylindrical in shape and formed with a radial threaded hole and an eccentric threaded hole which are located close to an end of the positioner, the positioner being rotatably fitted in the adjuster with the radial threaded hole and the eccentric threaded hole located in the slot, another end of the positioner having a top formed with a first lug and a bottom with a second lug, a packing plate arranged on the shoulders of the circular seats and engaged with the positioner by a fixing bolt which extends through the packing plate the positioner, and a musical instrument supporter having an upper end configured to engage with a musical instrument and a lower end having threads engageable with a threaded hole of the positioner.

It is the primary object of the present invention to provide an improvement in an adjusting structure for musical instrument supporters which can facilitate the adjustment of a musical instrument in position and orientation.

It is another object of the present invention to provide an improvement in the adjusting structure for musical instrument supporters which enables a musical instrument supporter to be folded to a position in parallel with a supporting leg thereby minimizing the space required for storing the musical instrument supporter.

It is still another object of the present invention to provide an improvement in the structure for musical instrument supporters which allows a musical instrument to be adjusted steplessly.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
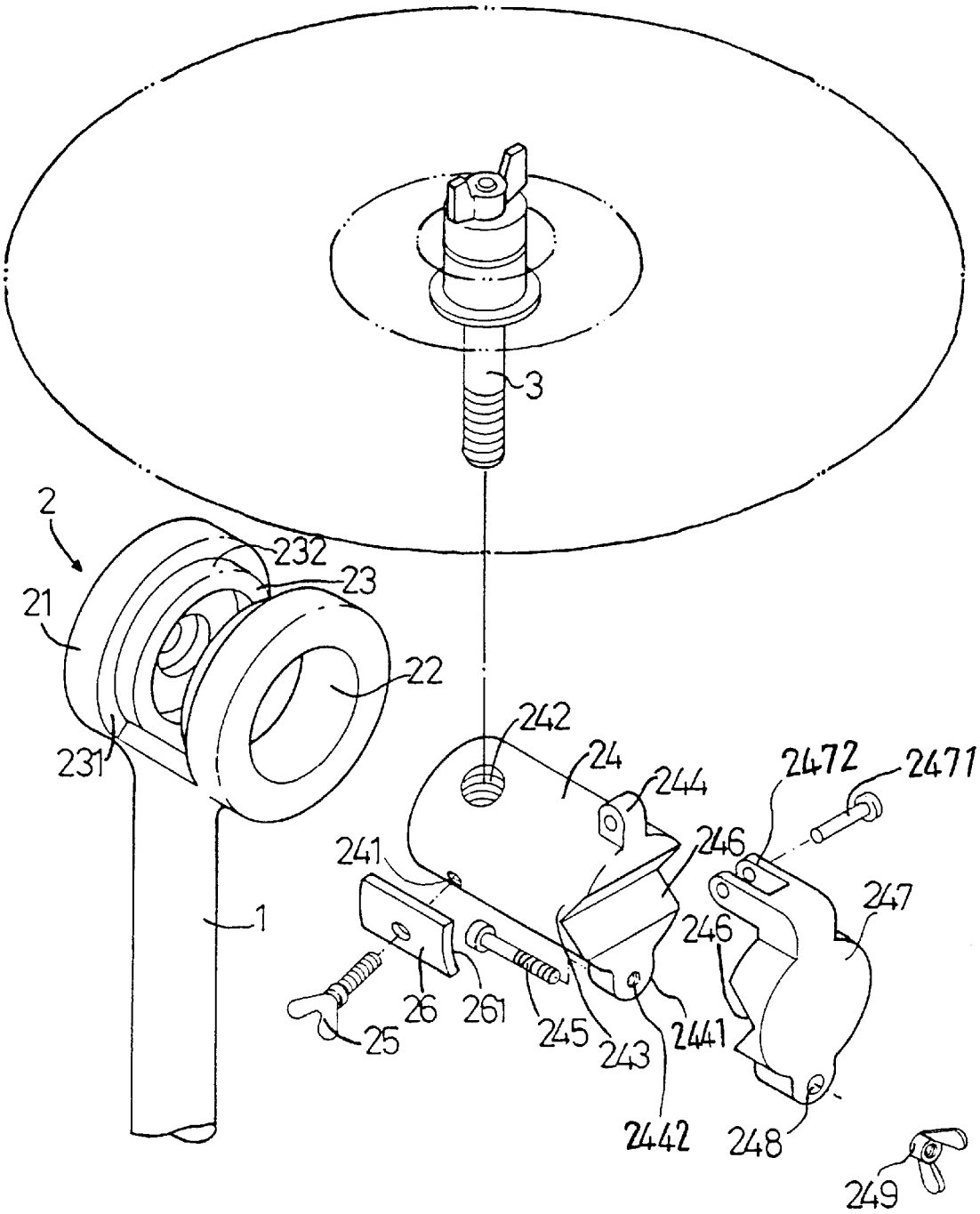
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2B:
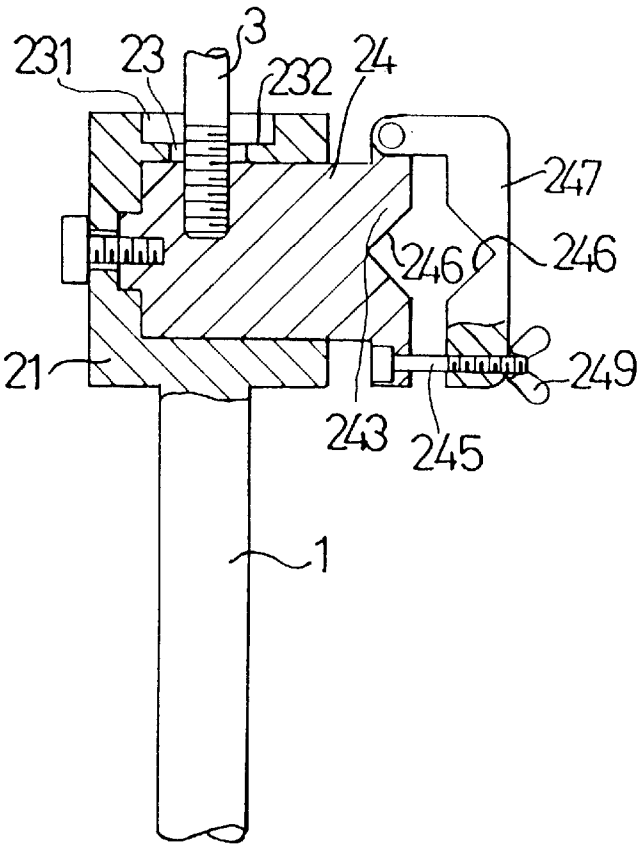
FIG. 2B is another sectional view of the present invention.
Figure 2A:
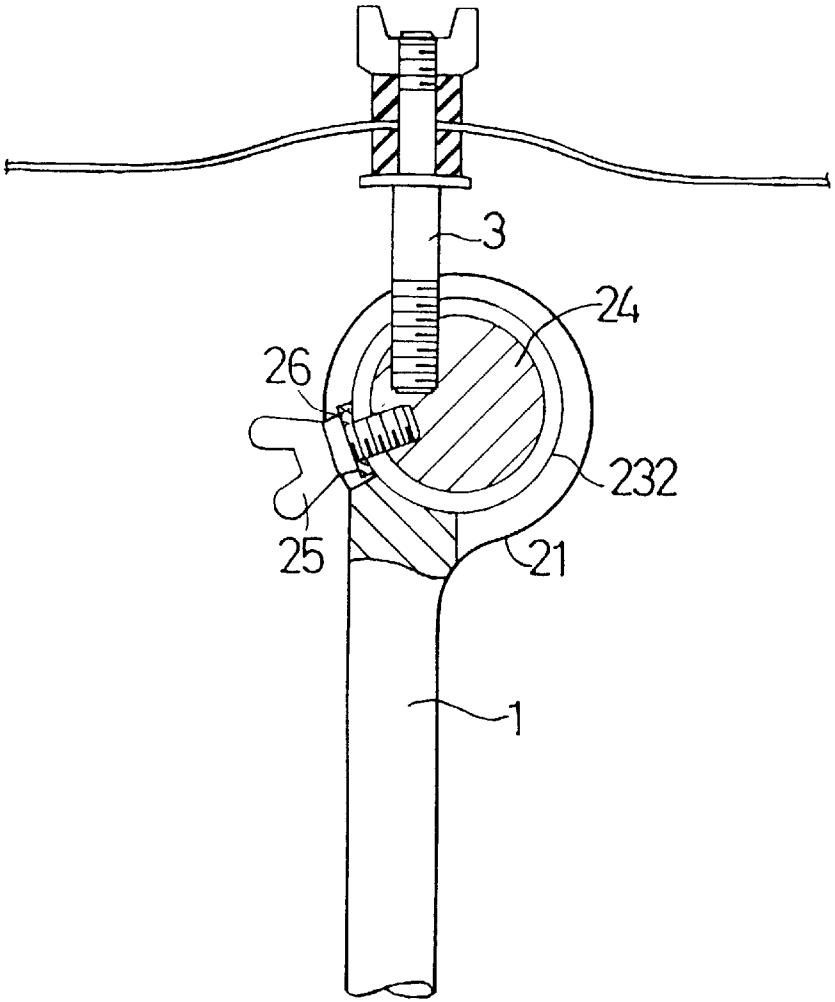
FIG. 2A is a sectional view of the present invention.

With reference to the drawings and in particular to FIGS. 1 and 2 thereof, the adjusting structure for musical instrument supporters according to the present invention generally comprises a supporting leg 1, an adjuster 2, a musical instrument supporter 3, a positioner 24 and a cap 247.

The adjuster 2 is integrally formed with the upper end of the supporting leg 1 and comprises two circular seats 21 which are spaced apart by a slot 23. The circular seats 21 are eccentric with respect to the longitudinal axis of the supporting leg 1 and have a horizontal axis. The circular seat 21 has a center hole 22 and is formed with a shoulder 232 and an edge 231 at the inner side thereof.

A positioner 24 is fitted in the adjuster 2 through the hole 22 of the circular seat 2. The positioner 24 is generally cylindrical in shape and formed with a radial threaded hole 241 and an eccentric threaded hole 242 which are located close to an end of the positioner 24. The positioner 24 is fitted in the adjuster 2 through the hole 22 so that the radial threaded hole 241 and the eccentric threaded hole 242 are located in the slot 23. Another end 243 of the positioner 24 formed at the top with a first lug 244 and a second lug 2441 at the bottom. The intermediate portion of the end 243 is formed with a V-shaped recess 246. The cap 247 is formed with a V-shaped recess 246 opposite to the V-shaped recess of the positoner 24 and has a pair of ears 2472 at the top engageable with the lug 244 of the positioner 24 and a hole 248 at the bottom aligned with the hole of the threaded hole 2442 of the positioner 24. The cap 247 is pivotally connected with the positioner 24 by a bolt 2471 extending through the ears 2472 and the lug 244. A screw 245 extends through the threaded hole 2442 and the hole 248 to engage with a wing nut 249.

A packing plate 26 is arranged on the shoulders 232 of the circular seats 21 and engaged with the positioner 24 by a fixing bolt 25 which extends through the packing plate 26 into a threaded hole 241 of the positioner 24, as shown in FIGS. 1, 2A, 2B and 3. The packing plate 26 has an inner curved surface adapted to engage with the positioner 24.

The musical instrument supporter 3 has an upper end configured to engage with a musical instrument and a lower end having threads engageable with a threaded hole 242 of the positioner 24.

Figure 3:
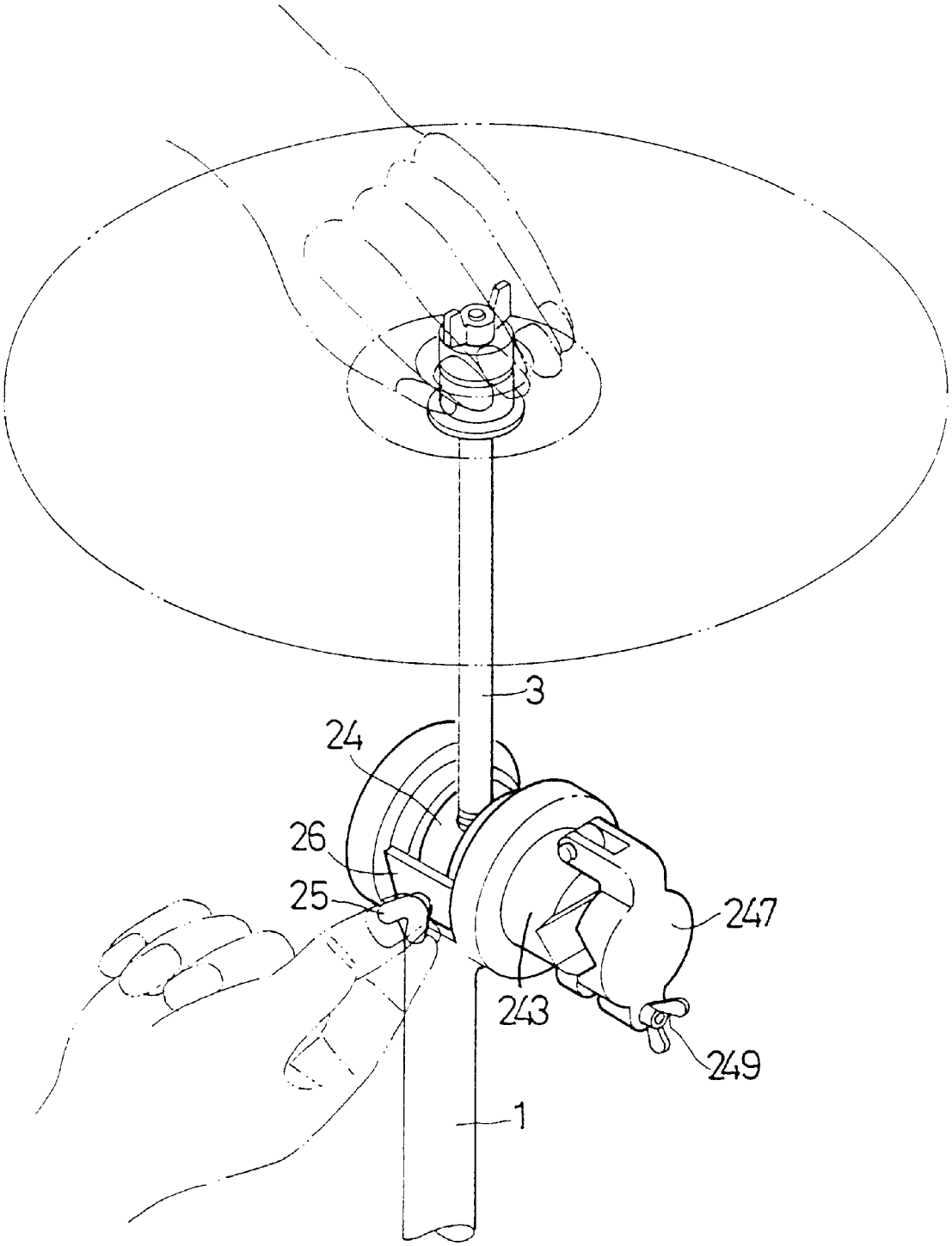
FIG. 3 is a working view of the present invention.

As the fixing bolt 25 and the musical instrument supporter 3 are two independent members, when desired to adjust the position and orientation of a musical instrument, it is necessary to hold the musical instrument with one hand and tighten or loosen the fixing bolt 25 with the other hand, as shown in FIG. 3. When the fixing bolt 25 is turned tight, the inner curved surface 261 of the packing plate 26 will be pushed against the shoulders 232 to fix the positioner 24 so that the position of the musical instrument can be adjusted steplessly thereby enabling the musical instrument to be adjusted to the desired position.

Figure 4:
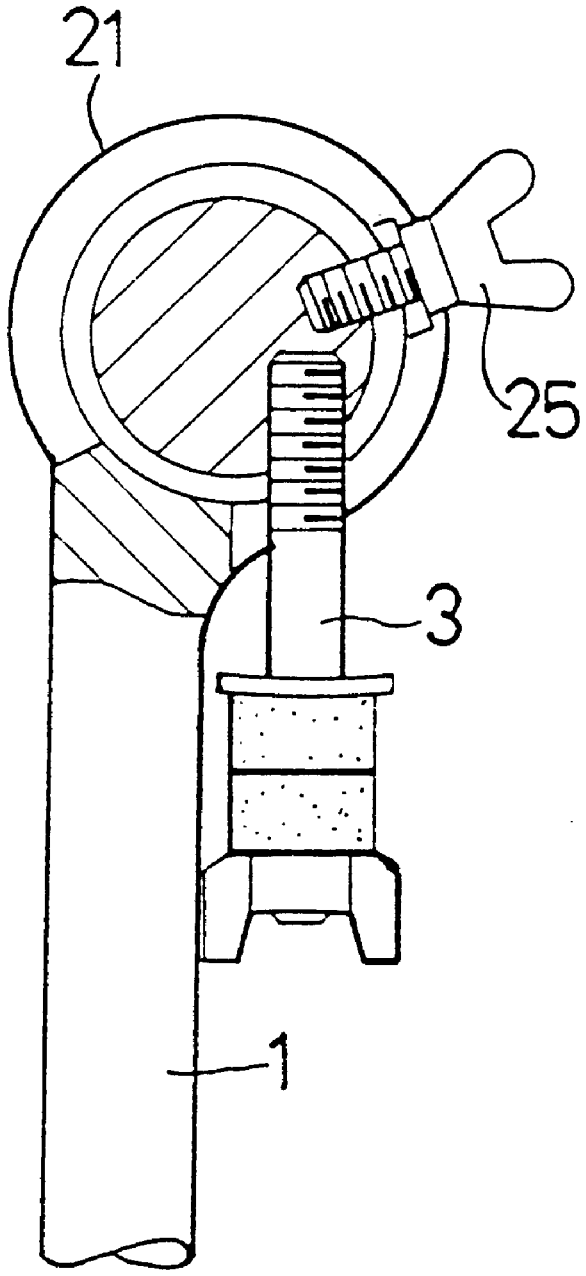
FIG. 4 illustrates how the present invention is folded.

When desired to fold the musical instrument supporter 3, the fixing bolt 25 is first loosened and then the positioner 24 is turned downwardly as shown in FIG. 4. As the musical instrument supporter 3 is eccentrically connected with the positioner 24 and the seats 21 are arranged eccentrically with respect to the supporting leg 1, the musical instrument supporter 3 can be folded to a position in parallel with the supporting leg 1 thereby minimizing the space required for storing the musical instrument supporter.

When desired to fix an additional equipment in place, it is only necessary to loosen the nut 249 to open the cap 247 thereby enabling the equipment to be kept between the positioner 24 and the cap 247.

Figure 5:
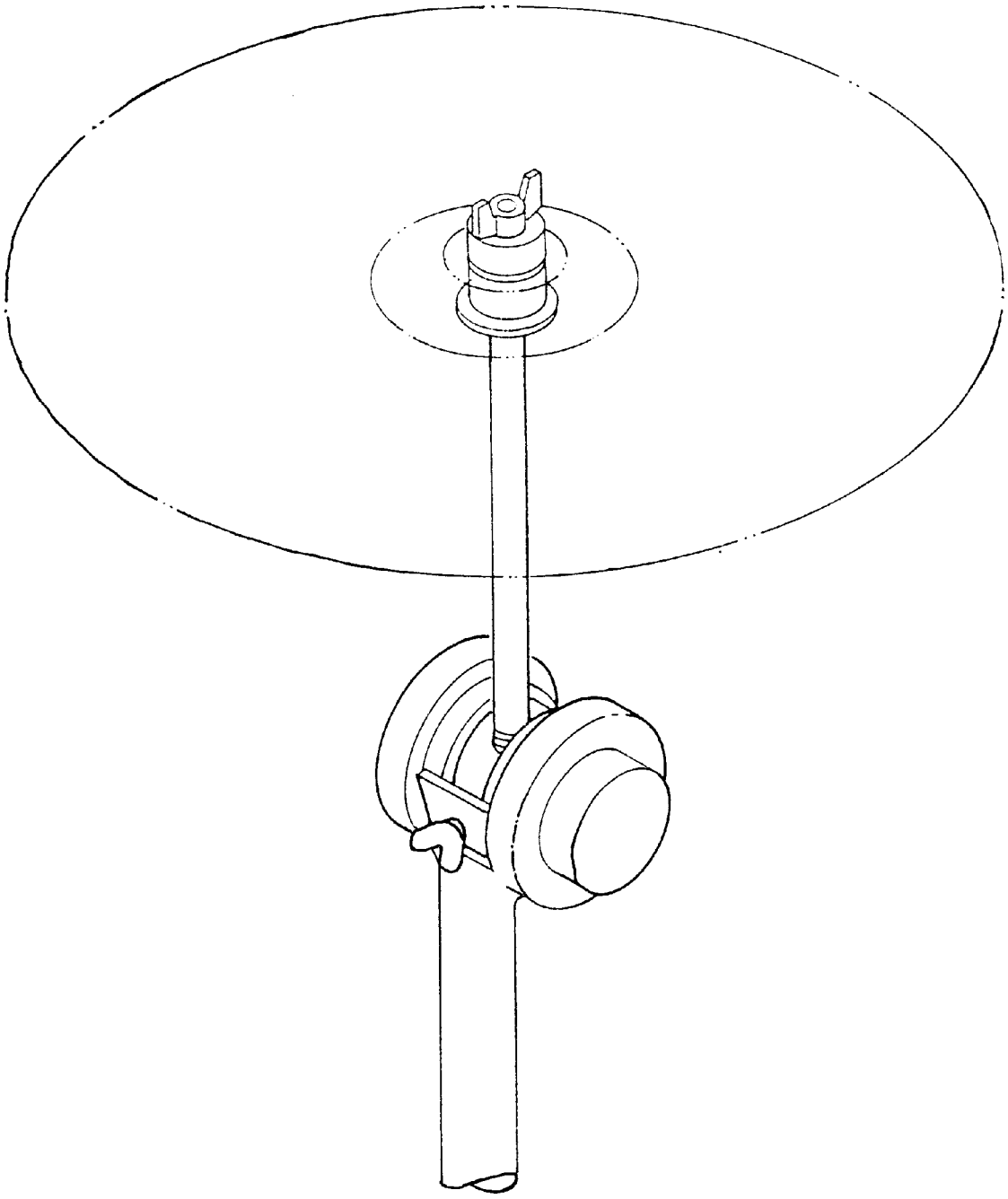
FIG. 5 illustrates a second preferred embodiment of the present invention.

FIG. 5 illustrates another preferred embodiment of the present invention. As shown, the positioner does not have a V-shaped recess and is not engaged with a cap.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An adjusting structure for musical instrument supporters comprising:

supporting leg;

an adjuster integrally formed with an upper end of said supporting leg and having two circular seats which is spaced apart by a slot, each of said circular seats having a center hole and formed with a shoulder;

a positioner being generally cylindrical in shape and formed with a radial threaded hole and an eccentric threaded hole which are located close to an end of said positioner, said positioner being rotatably fitted in said adjuster with said radial threaded hole and the eccentric threaded hole located in said slot, another end of said positioner having a top formed with a first lug and a bottom with a second lug having a threaded hole;

a packing plate arranged on shoulders of said circular seats and engaged with said positioner by a fixing bolt which extends through said packing plate to engage said positioner; and a musical instrument supporter having an upper end configured to engage with a musical instrument and a lower end having threads engageable with said eccentric threaded hole of said positioner.

2. The adjusting structure for musical instrument supporters as claimed in claim 1, wherein another end of said positioner has an intermediate portion of said another end being formed with a V-shaped recess, said positioner being engaged with a cap formed with a V-shaped recess opposite to said V-shaped recess of said positoner and having a pair of ears engageable with said first lug of said positioner and a hole aligned with said threaded hole of said second lug of said positioner, said cap being pivotally connected with said positioner by a bolt extending through said ears and said first lug, a screw extending through said threaded hole and said hole of said cap to engage with a wing nut.

3. The adjusting structure for musical instrument supporters as claimed in claim 1, wherein said circular seats are eccentrically provided at said upper end of said supporting leg.

* * * * *